US008994284B2

(12) United States Patent
Zhang et al.

(10) Patent No.: US 8,994,284 B2
(45) Date of Patent: Mar. 31, 2015

(54) HIGH INTENSITY DISCHARGE LAMP CONTROL CIRCUIT AND CONTROL METHOD

(75) Inventors: Qi Zhang, Shanghai (CN); Weiqiang Zhang, Shanghai (CN); Jianping Ying, Shanghai (CN)

(73) Assignee: Delta Electronics (Shanghai) Co., Ltd. (CN)

( * ) Notice: Subject to any disclaimer, the term of this patent is extended or adjusted under 35 U.S.C. 154(b) by 700 days.

(21) Appl. No.: 13/339,063

(22) Filed: Dec. 28, 2011

(65) Prior Publication Data

US 2013/0020959 A1 Jan. 24, 2013

(30) Foreign Application Priority Data

Jul. 18, 2011 (CN) ..... 2011 1 0201182

(51) Int. Cl.

| | |
|---|---|
| ***H05B 37/02*** | (2006.01) |
| ***H05B 39/04*** | (2006.01) |
| ***H05B 41/36*** | (2006.01) |
| ***H05B 41/288*** | (2006.01) |
| *H05B 41/282* | (2006.01) |

(52) U.S. Cl.

CPC ..... *H05B 41/288* (2013.01); *H05B 41/2887* (2013.01); *H05B 41/2881* (2013.01); *H05B 41/2827* (2013.01)

USPC ..... 315/224; 315/226; 315/291; 315/308

(58) Field of Classification Search

None

See application file for complete search history.

(56) References Cited

U.S. PATENT DOCUMENTS

| | | | | |
|---|---|---|---|---|
| 6,069,458 | A | 5/2000 | Takehara et al. | |
| 6,181,076 | B1 | 1/2001 | Trestman et al. | |
| 6,577,078 | B2 * | 6/2003 | Shen | 315/307 |
| 8,395,327 | B2 * | 3/2013 | Kumagai et al. | 315/224 |
| 2006/0049777 | A1 * | 3/2006 | Kumagai et al. | 315/224 |
| 2011/0085362 | A1 | 4/2011 | Bordin | |

FOREIGN PATENT DOCUMENTS

| | | |
|---|---|---|
| CN | 102057562 | 5/2011 |
| JP | 2010-114091 | 5/2010 |
| TW | 508977 | 11/2002 |

* cited by examiner

*Primary Examiner* — Anh Tran

(74) *Attorney, Agent, or Firm* — Lowe Hauptman & Ham, LLP

(57) ABSTRACT

A high intensity discharge lamp (HID) control circuit and method are provided in the present invention. The circuit includes a first winding and a second winding, both of which are coupled with a series-connected inductor of an HID lamp circuit; a current zero point detector for detecting an inductor current zero crossing signal in the HID lamp circuit; an inductor current signal generator for generating an inductor current signal in the circuit to indicate a current value of the HID lamp; a modulator having input terminals connected to the current zero point detector and the inductor current signal generator, respectively, and an output terminal connected to a driving circuit for the HID lamp; and the driving circuit for driving switches in the HID lamp control circuit.

18 Claims, 11 Drawing Sheets

HIGH INTENSITY DISCHARGE LAMP CONTROL CIRCUIT AND CONTROL METHOD

TECHNICAL FIELD OF THE INVENTION

The present invention relates to a high intensity discharge (HID) lamp, and more particularly, to a high intensity discharge lamp control circuit and control method.

BACKGROUND OF THE INVENTION

A high intensity discharge (HID) lamp has become a dot light source of the third generation after the incandescent lamp and the fluorescent lamp due to a lot of advantages such as high luminous efficiency, long lifetime and wide power range of the HID lamp. The HID lamps are widely applied in indoor and outdoor illumination environments such as plazas, docks, workshops and roads. However, both end electrodes of the HID lamp conduct no electricity in a normal state, an activating pulse of a high voltage is required to ignite the HID lamp. The HID lamp needs a ballast that provides an output voltage of 200-300 volts for forming a stable electric arc in addition to an ignition pulse. After the electric arc is generated, a high pressure gas mixture formed by metal halide and mercury vapor in the lamp may emit usable lights of a spectrum similar to the solar spectrum during the temperature raising stage. Once the electric arc is generated, the ballast must limit a magnitude of a current. Otherwise, the electric arc may result in a high current, which will damage the ballast and the lamp.

The structure of the ballast for the HID lamp can be referred to FIG. 1. FIG. 1 is a block diagram showing a conventional three-stage ballast module, which includes three portions: a power factor circuit (PFC) 101, a DC-DC converter circuit 102, and an inverter circuit 103. The DC-DC converter circuit 102 is a buck structure. The inverter circuit 103 is usually a full-bridge or half-bridge circuit. In order to reduce the cost and size of the ballast, the DC-DC converter circuit and the inverter circuit can be combined together, as shown in FIG. 2, a two-stage ballast comprises a power factor circuit 201 and an inverter circuit 203. An implementation structure of the two-stage ballast can be referred to FIG. 3. In this example, the power factor circuit 201 comprises an inductor L1, a field effect transistor (FET) S1 and a diode D1. The inverter circuit 203 utilizes a half-bridge structure. An inductor L2 and a capacitor C3 form a filter for filtering off a high frequency switching signal. According to the requirement for controlling the HID lamp, a current is controlled at a constant level during the lamp electrodes are heated. After a lamp resistance attains a stable value, the lamp power is controlled to be constant by adjusting the level of the lamp current. Therefore, it is necessary to control the current level of the HID lamp. Further, the inductor current is kept to operate in a critical continuous inductor current mode by detecting a zero point signal of the inductor current in the circuit, and thereby improving the efficiency of the HID lamp.

SUMMARY OF THE INVENTION

An objective of the present invention is to provide a technical solution, which can detect an inductor current zero crossing signal in a circuit and control a lamp current of an HID lamp with a simple structure and low cost.

To attain the above objective, the present invention provides an HID lamp control circuit comprising a first winding and a second winding, both of which are both coupled with a series-connected inductor of an HID lamp; a current zero point detector for detecting an inductor current zero-crossing signal in a circuit, input terminals thereof being respectively connected with a different-name end of the first winding and a same-name end of the second winding, and an output end thereof being connected with a modulator; an inductor current signal generator for generating the inductor current signal in the circuit so as to control a lamp current of the HID lamp, input terminals thereof being respectively connected with the different-name end of the first winding and the same-name end of the second winding, and an output end thereof being connected with the modulator; the modulator having input terminals thereof respectively connected with the current zero point detector and the inductor current signal generator, and an output terminal thereof connected to a driving circuit for the HID lamp to output a modulation signal to the driving circuit; and the driving circuit for driving a switching transistor and thereby driving the HID lamp to emit lights, an input terminal thereof being connected with the modulator as well as a first external signal and a second external signal, an output terminal thereof being connected to the HID lamp through an inverter circuit. The driving circuit receives the modulation signal from the modulator, and controls the inductor current to operate in a critical continuous inductor current mode accordingly.

In an embodiment of the present invention, the current zero point detector comprises a detecting circuit. The detecting circuit generates a zero detecting signal to be outputted to the modulator according to a level of the first winding and the first external signal or according to a level of the second winding and the second external signal.

In an embodiment of the present invention, the detecting circuit of the current zero point detector comprises: a first AND gate having a first input terminal electrically coupled to an output terminal of the first winding and a second input terminal electrically coupled to the driving circuit of the HID lamp; and a second AND gate having a first input terminal electrically coupled to an output terminal of the second winding and a second input terminal electrically coupled to the driving circuit of the HID lamp; output terminals of the first AND gate and the second AND gate are both electrically connected to the modulator.

In an embodiment of the present invention, the detecting circuit of the current zero point detector further comprises a first OR gate having two input terminals thereof electrically coupled to the output terminal of the first AND gate and the output terminal of the second AND gate, respectively and an output terminal electrically coupled to the modulator.

In an embodiment of the present invention, the inductor current signal generator comprises a capacitive unit, which is directly connected with the modulator. The capacitive unit starts to be charged when a modulation signal generated by the modulator is valid.

In an embodiment of the present invention, the inductor current signal generator further comprises a first switch unit and a second switch unit connected in series. The first switch unit is connected to the modulator. The second switch unit is connected to the capacitive unit. When the modulation signal generated by the modulator is valid, the first switch unit is turned on and the second switch unit is turned off, so that the capacitive unit is charged by the first winding or the second winding. When the modulation signal generated by the modulator is invalid, the first switch unit is turned off and the second switch is turned on, so that the capacitive unit is discharged.

In an embodiment of the present invention, the first switch unit comprises a first field effect transistor (FET), and the second switch unit comprises a second FET. The first FET has a gate thereof electrically coupled to the modulator, and a drain thereof electrically coupled to a gate of the second FET. The second FET is electrically connected to the capacitive unit.

In an embodiment of the present invention, the inductor current signal generator further comprises a capacitor charging control unit. Input terminals of the capacitor charging control unit are electrically coupled to the first winding and the second winding, and an output terminal thereof is electrically coupled to the capacitive unit. The capacitor charging control unit permits a current to flow from the input terminal to the output terminal, while prohibits the current to flow from the output terminal to the input terminal. In one technical solution, the capacitor charging control unit may include two diodes. Positive poles of the two diodes serve as the input terminals of the capacitor charging control unit and are electrically coupled to the first winding and the second winding, respectively; and the negative poles thereof both serve as the output terminal and are electrically connected to the capacitive unit.

In an embodiment of the present invention, the inductor current signal generator comprises a voltage control current source, of which input terminals are electrically coupled to the first winding and the second winding, an output terminal is electrically connected to the capacitive unit.

In an embodiment of the present invention, the modulator outputs the modulation signal to the driving circuit according to the level of the first winding and the first external signal, alternatively, according to the level of the second winding and the second external signal.

In an embodiment of the present invention, the driving circuit drives the HID lamp through the inverter circuit when the modulation signal from the modulator is valid and one of the first external signal and the second external signal is also valid.

In an embodiment of the present invention, the first winding and the second winding have the same number of turns.

In an embodiment of the present invention, a polarity of the signal related to the inductor current zero crossing signal is the same or opposite with respect to a polarity of the inductor current zero crossing signal.

In an embodiment of the present invention, a third input terminal of the inductor current signal generator is connected to the output terminal of the current zero point detector.

To attain the above objective, the present invention further provides an HID lamp control method, which comprises the following steps: providing a first winding and a second winding, the first winding and the second winding being both coupled to a series-connected inductor of the HID lamp, a different-name end of the first winding being an output terminal thereof and a same-name end of the second winding being an output terminal thereof; generating an inductor current zero-crossing signal and an inductor current signal for the series-connected inductor by using a voltage of the first winding or the second winding; generating a modulation signal by using inductor current zero-crossing signal and the inductor current signal; and controlling the inductor current to operate in a critical continuous inductor current mode according to the modulation signal, a first external signal and a second external signal.

In an embodiment of the present invention, the voltage of the first winding or the second winding is integrated. The integrating process starts when the modulation signal is generated.

In an embodiment of the present invention, the voltage of the first winding or the second winding is integrated by providing a capacitive unit. In addition, the method further comprises providing a first switch unit and a second switch, connecting the first switching unit to the modulator, and connecting the second switch unit to the capacitive unit; turning on the first switch unit while turning off the second switch unit when the modulation signal generated by the modulator is valid so as to charge the capacitive unit through the first winding or the second winding; turning off the first switch unit while turning on the second switch unit when the modulation signal generated by the modulator is invalid so as to discharge the capacitive unit.

The technical solution provided by the present invention has the following advantages:

In accordance with the present invention, the inductor current is in the critical continuous inductor current mode. The voltage of the first winding or the second winding coupled with the series-connected inductor of the HID lamp is detected by the current zero point detector. The driving signal for the HID lamp is changed by the modulator when the voltage of the first winding or the second winding drops to zero, so that the inductor current operates in the critical continuous inductor current mode. The efficiency of the HID lamp system is promoted, and it is possible to control the current of the HID lamp.

In accordance with the present invention, an integral circuit composed of a resistor and a capacitor is provided at the output terminals of the first winding and the second winding, so as to control the current of the HID lamp. The current is usually controlled at a constant current value during a stage in which the lamp is heated. After a resistance of the lamp reaches a stable state, the level of the current is adjusted for controlling the lamp power to be constant, and thereby a damage of the HID lamp is avoided.

In accordance with the present invention, the inductor current is controlled to operate in the critical continuous inductor current mode by detecting a voltage zero-crossing signal of the first winding or the second winding. When the inductor current is reverse, FETs S2 and S3 in a half-bridge circuit shown in FIG. 3 can be turned on by a zero voltage, and therefore wear of the transistors can be reduced and service lifetime of the transistors can be prolonged.

DETAILED DESCRIPTION OF THE INVENTION

In the following descriptions, the term "connect" means "electrically connect" if not specifically defined.

Figure 4:
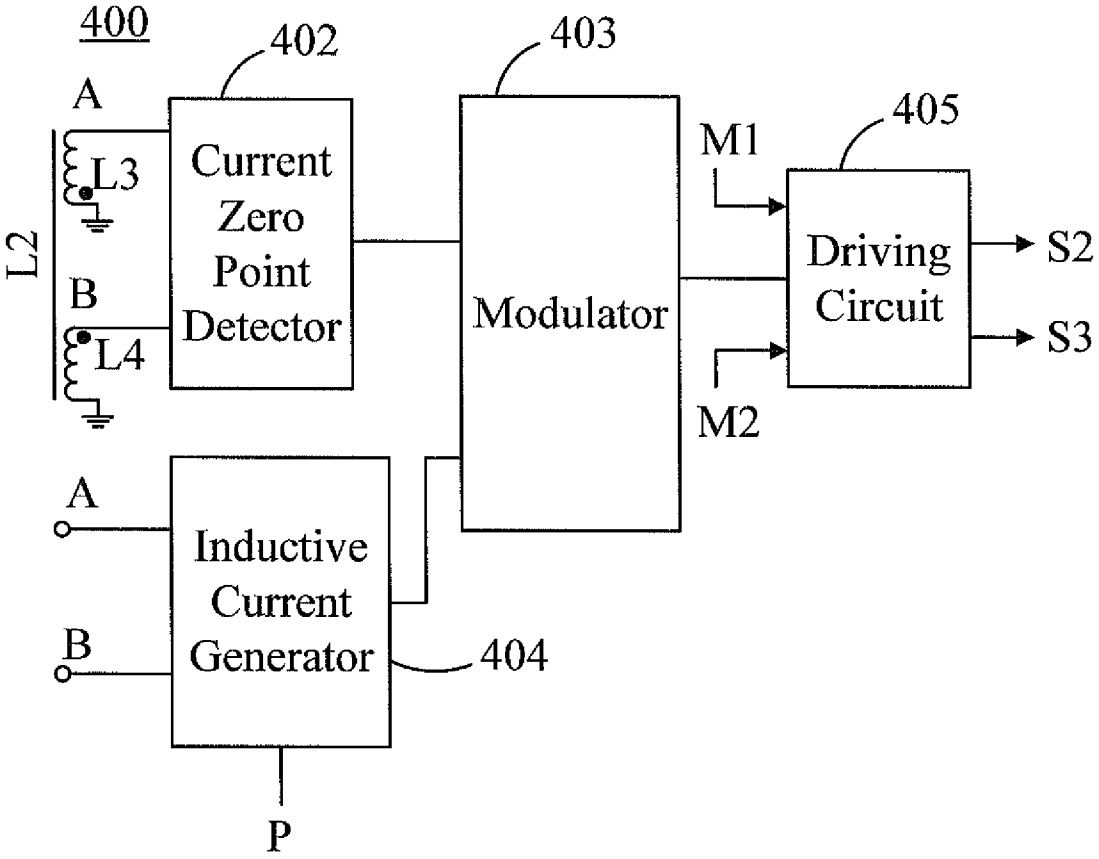
FIG. 4 is a block diagram showing an HID lamp control circuit in accordance with an embodiment of the present invention.

FIG. 4 is a block diagram showing an HID lamp control circuit in accordance with an embodiment of the present invention. A terminal "P" shown in this drawing can be connected to an output terminal of a current zero point detector 402 or an output terminal of a modulator 403. This drawing will be described in detail as follows in conjunction with FIG. 5 and FIG. 6.

Figure 5:
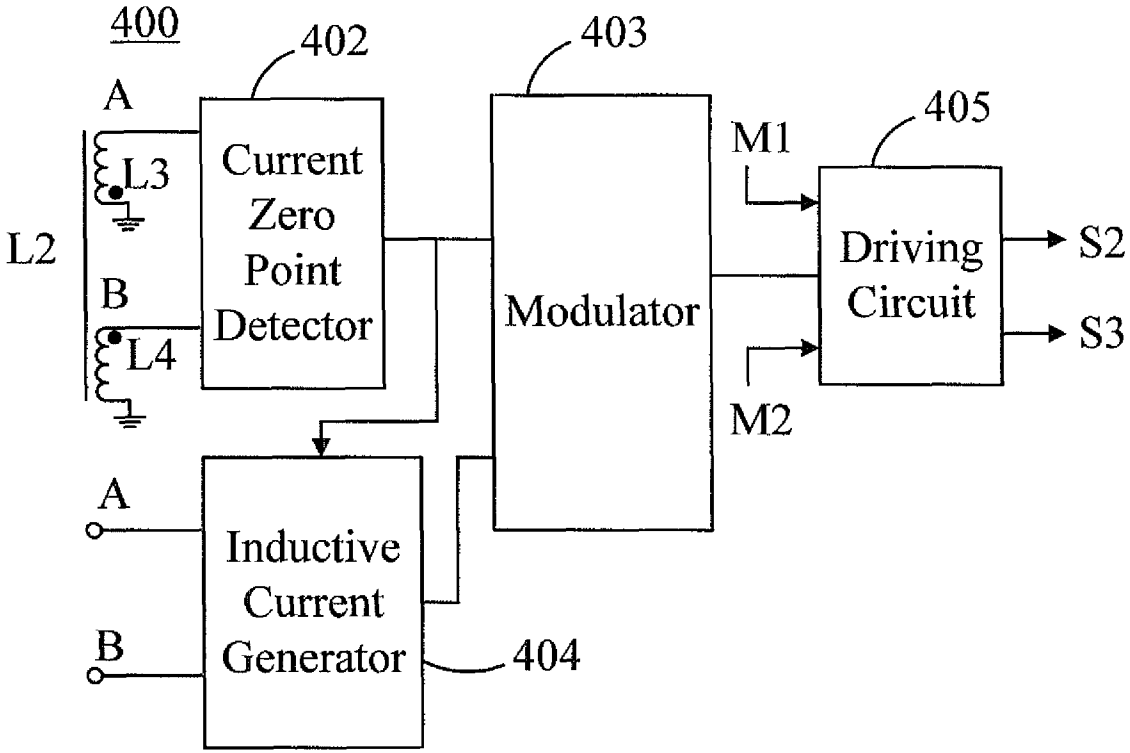
FIG. 5 is a block diagram showing a specific HID lamp control circuit in accordance with another embodiment of the present invention.

Please refer to FIG. 5, which shows a specific HID lamp control circuit 400 in accordance with the present invention. Please also refer to FIG. 6. The control circuit 400 comprises a first winding L3 and a second winding L4, a current zero point detector 402, an inductor current signal generator 404, a modulator 403, and a driving circuit 405. The first winding L3 and the second winding L4 have the same number of turns. The first winding L3 and the second winding L4 are both coupled to a series-connected inductor L2 of the HID lamp. The first winding L3 has a different-name end A. The second winding L4 has a same-name end B. The current zero point detector 402 has a first input terminal, a second input terminal and an output terminal. The first input terminal of the current zero point detector 402 is connected to the different-name end A of the first winding L3, and the second input terminal of the current zero point detector 402 is connected to the same-name end B of the second winding L4 for detecting a zero-crossing signal of an inductor current of the HID lamp. The output terminal of the current zero point detector 402 is connected to the modulator 403 and the inductor current signal generator 404. The inductor current signal generator 404 has a first input terminal, a second input terminal, a third input terminal and an output terminal, and is used to generate an inductor current signal in the circuit so as to control a lamp current of the HID lamp. The inductor current signal generator 404 has the first input terminal connected to the different-name end A of the first winding L3, the second input terminal connected to the same-name end B of the second winding L4, the third input terminal receiving a signal related to the inductor current zero-crossing signal. The modulator 403 has a first input terminal, a second input terminal and an output terminal. The first input terminal and the second input terminal of the modulator 403 are connected to the output terminal of the current zero point detector 402 and the output terminal of the inductor current signal generator 404, respectively. The output terminal of the modulator 403 is connected to the driving circuit 405 for the HID lamp and outputs the modulation signal to the driving circuit 405. The driving circuit 405 has a first input terminal, a second terminal, a third terminal and an output terminal and is used for driving a switch in the HID lamp control circuit. The first input terminal of the driving circuit 405 is connected to the output terminal of the modulator 403 for receiving the modulation signal. The second input terminal and the third input terminal of the driving circuit 405 receive a first external signal M1 and a second external signal M2, respectively. The output terminal of the driving circuit 405 is connected to the HID lamp through an inverter circuit to control the inductor current to operate in a critical continuous inductor current mode.

Figure 6:
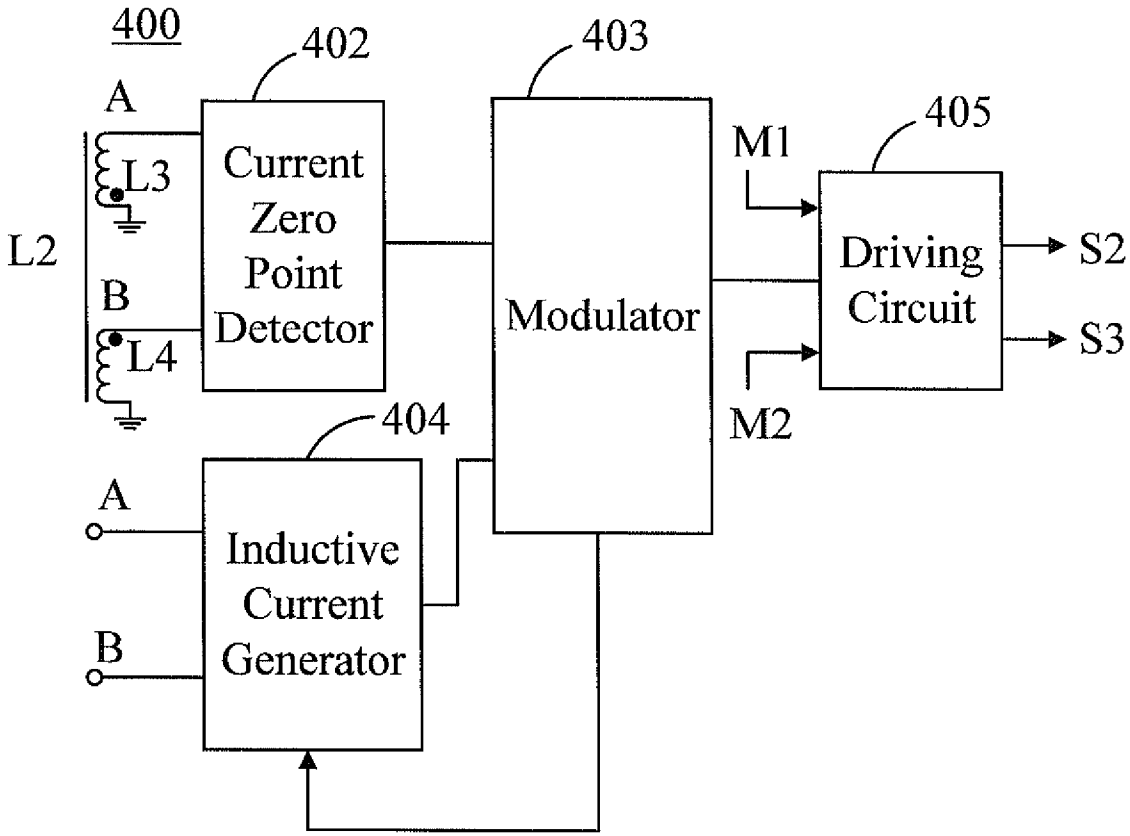
FIG. 6 is a block diagram showing a specific HID lamp control circuit in accordance with a further embodiment of the present invention.

In the present embodiment, the signal related to the inductor current zero-crossing signal can be an output signal from the current zero point detector 402, as shown in FIG. 5, alternatively, it can be an output signal from the modulator 403, as shown in FIG. 6. In the present embodiment, the numbers of turns of the first winding and the second winding can be the same.

As described, the first winding L3 and the second winding L4 are coupled with the inductor L2. The output terminals of the first winding L3 and the second winding L4 output a generated inductor current. When the inductor current in the circuit is controlled in a critical continuous state, the relationship between the inductor current and the current of the HID lamp is as follows:

$$I_{LAMP} = \frac{I_{L2_peak}}{2}$$

A formula for calculating a peak value of the inductor current is as follows:

$$I_{L2_peak} = \frac{U_{L2} * \Delta t}{L_2}$$

Wherein $I_{LAMP}$ indicates a current flowing through the HID lamp; $I_{L2_peak}$ indicates a peak value of a current flowing through the inductor L2; $U_{L2}$ indicates a voltage of the inductor L2; Δt indicates a time change; $L_2$ indicates an inductance of the inductor L2.

The voltage $U_{L2}$ of the inductor L2 can be measured through the first winding L3 and the second winding L4 as follows:

$$U_{L2}=n*U_A, \text{ or}$$

$$U_{L2}n*U_B$$

In the equations, n indicates a ratio of the turns of the first winding L3 or the second winding L4 to that of the inductor L2; $U_{L3}$ indicates a voltage of the first winding L3; $U_{L4}$ indicates a voltage of the second winding L4.

Since a inductive reactance of the inductor L2 can be known, the peak value $I_{L2_peak}$ of the inductor current $I_{L2}$ can be expressed as:

$$I_{L2_peak} = k_1 * U_{L2} * \Delta t = k_2 * U_A * \Delta t,$$

$$\left(k_1 = \frac{1}{L_2}, k_2 = \frac{n}{L_2}\right)$$

$$I_{Lamp} = k_3 * U_A * \Delta t, \left(k_3 = \frac{n}{2 * L_2}\right)$$

Therefore, the current of the HID lamp can be calculated through the mixed winding coupled voltages by using the above formula.

When the value of the current of the inductor L2 varies from positive to negative or from negative to positive, the output voltages of the first winding L3 and the second winding L4 change their polarities. The change of the output voltages of the first winding L3 and the second winding L4, no matter changes from positive to negative or from negative to positive, can be used to embody a current zero-crossing signal of the inductor L2. In addition, the level of the lamp current of the HID lamp can be controlled by integrating the voltages of the first winding L3 and the second winding L4.

Figure 7:
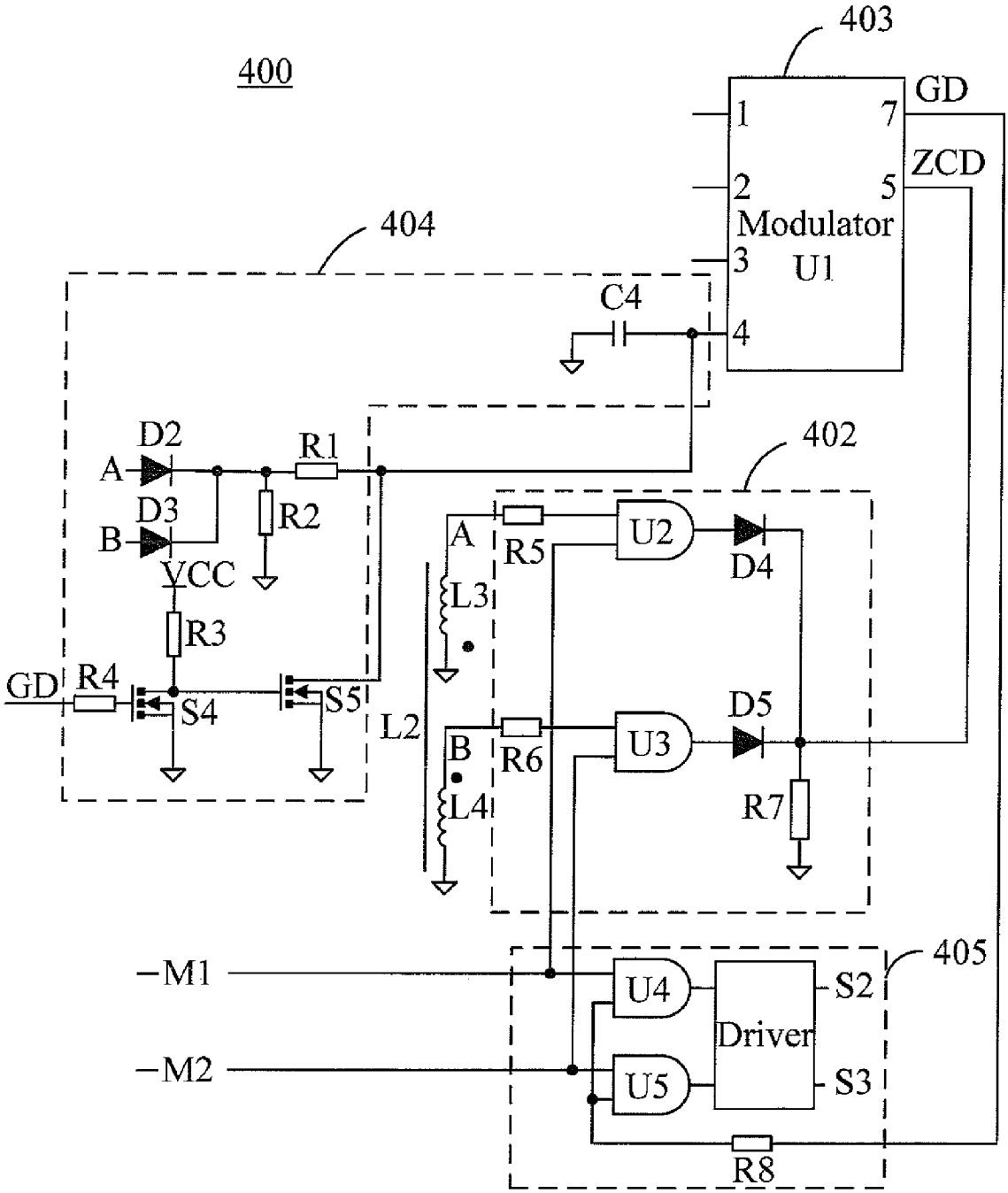
FIG. 7 is a circuitry diagram of the control circuit of FIG. 6.

FIG. 7 is a detailed circuitry diagram of the control circuit of FIG. 6.

Please refer to FIG. 7, the first winding L3 and the second winding L4 having the same number of turns are coupled with the inductor L2. The different-name end A of the first winding L3 and the same-name end of the second winding L4 are both connected to the current zero point detector 402.

The current zero point detector 402 comprises a detecting circuit composed of an AND gate U2 and an AND gate U3, a current limiting resistor R5, a current limiting resistor R6, a diode D4, a diode D5, and a protecting resistor R7. A first input terminal of the AND gate U2 is electrically connected to the output terminal A of the first winding L3, and a second input terminal thereof is connected to the driving circuit 405 for the HID lamp. A first input terminal of the AND gate U3 is electrically connected to the output terminal B of the second winding L4, and a second input terminal thereof is electrically connected to the driving circuit 405 of the HID lamp. Output terminals of the AND gate U2 and the AND gate U3 are both electrically connected to a first input terminal of a modulator U1. The modulator U1 is a chip which is an implementation of the modulator 403 of FIG. 5. The modulator U1 may control a duty cycle of a switch signal and a switching frequency of the switch signal. A first terminal of the current limiting resistor R5 is connected to the output terminal A of the first winding L3, and a second terminal thereof is connected to the first input terminal of the AND gate U2. A first terminal of the current limiting resistor R6 is connected to the output terminal B of the second winding L4, and a second terminal thereof is connected to the first input terminal of the AND gate U3. A positive pole of the diode D4 is connected to the output terminal of the AND gate U2, and a negative pole thereof is connected to the first input terminal of the modulator U1. A positive pole of the diode D5 is connected to the output terminal of the AND gate U3, and a negative pole thereof is connected to the first input terminal of the modulator U1. A terminal of the protecting resistor R7 is connected with the negative poles of the diodes D4 and D5, and the other terminal thereof is grounded.

The inductor current signal generator 404 comprises a capacitor C4, a diode D2, a diode D3, a current limiting resistor R1, a protecting resistor R2, a first switch unit S4, and a second switch unit S5. A first terminal of the capacitor C4 is connected to the modulator U1, and a second terminal thereof is grounded. The diode D2 is coupled between the first winding L3 and the current limiting resistor R1. A positive pole of the diode D2 is electrically connected to the first L3, and a negative pole thereof is connected to the current limiting resistor R1. A positive pole of the diode D3 is connected to the second winding L4, and a negative pole is connected to the current limiting resistor R1. The other terminal of the current limiting resistor R1 is connected to the first terminal of the capacitor C4. One terminal of the protecting resistor R2 is connected with the negative poles of the diodes D2 and D3, and the other terminal thereof is grounded. The first switch unit S4 is a field effect transistor (FET), of which a gate is connected to a driving resistor R4, a drain is connected to a high voltage via a pull-up resistor R3, and a source is grounded. The second switch unit S5 is a FET, of which a gate is connected to the drain of the FET S4, a drain is connected to the first terminal of the capacitor C4, and a source is grounded.

A fourth pin of the modulator U1 is the second input terminal for recording an output voltage of an integral circuit in the control circuit 400, the details thereof will be described later with reference to FIG. 9, and the lamp current of the HID lamp is calculated and controlled accordingly. A fifth pin is the first input terminal, and a seventh pin is the output terminal. The logic relationship between the fifth pin and the seventh pin is: when the inputted level of the fifth pin drops, the seventh pin is triggered to output a high level signal.

In the present embodiment, the current zero point detector 402 comprises a detecting circuit consisting of an AND gate U2 and an AND gate U3. The detecting circuit generates a zero point detecting signal ZCD and inputs the signal to the first input terminal of the modulator U1 when the voltage on the first winding L3 is high level and the first external signal M1 is high level, alternatively, when the voltage on the second winding L4 is high level and the second external signal M2 is high level. At the output terminal of the modulator U1 outputs a modulation signal, which is referred to as a gate circuit driving signal GD in the present embodiment, according to the zero point detecting signal ZCD at the first input terminal. The gate circuit driving signal GD is a high frequency signal for controlling high frequency switching of the FET S2 or the FET S3, so as to control the inductor current of the inductor L2, and thereby controlling the lamp current of the HID lamp accordingly. In order to reduce the size of the circuit, the frequency of the high frequency signal is in a range from tens of KHz to hundreds of KHz.

The inductor current signal generator 404 comprises the capacitor C4, of which the first terminal is connected with the second input terminal of the modulator U1, and the second terminal is grounded. The capacitor C4 starts to be charged when the gate circuit driving signal GD generated from the output terminal of the modulator U1 is high level, so as to generate a current value of the inductor L2 under the critical continuous inductor current mode. The lamp current of the HID lamp is calculated and controlled accordingly.

In addition, the inductor current signal generator 404 further comprises a capacitor charging control unit constituted by the diodes D2 and D2 connected in parallel, and the first switch unit S4 and the second switch unit S5 connected in series. The capacitor charging control unit is used for preventing a reverse parasitic current from interfering the first winding L3 and the second winding L4. Input terminals of the capacitor charging control unit are electrically connected with the first winding L3 and the second winding L4, and an output terminal is electrically connected to the first terminal of the capacitor C4. The capacitor charging control unit permits the current to flow from the input terminals to the output terminal, while prevents the current from flowing from the output terminal to the input terminals. The first switch unit S4 and the second switch unit S5 are connected in series. The first switch unit S4 is connected with the output terminal of the modulator U1. The second switch unit S5 is connected with the first terminal of the capacitor C4. When the gate circuit driving signal GD generated at the output terminal of the modulator U1 is high level, the first switch unit 84 is turned on and the second switch unit S5 is turned off, so that the capacitor C4 is charged by the first winding L3 or the second winding L4. When the gate circuit driving signal GD generated at the output terminal of the modulator U1 is low level, the first switch unit S4 is turned off and the second switch unit S5 is turned on, so that the capacitor C4 is discharged. In the present embodiment, the first switch unit S4 comprises a first FET, and the second switch unit S5 comprises a second FET. A gate of the first FET is electrically connected to the output terminal of the modulator U1. A drain of the first FET is electrically connected to a gate of the second FET. The second FET is electrically connected with the first terminal of the capacitor C4. Of course, S4 and S5 are not limited to FETs, they can be implemented by bipolar junction transistors (BJTs), insulated gate bipolar transistors (IGBTs) or other switches.

Please refer to FIG. 7 again, the driving circuit 405 is connected to the FET S2 and the FET 83 of the inverter circuit via a driver. The main function of the driver is to enhance signal driving capability and to implement high voltage driving. The driver can be implemented by a driver chip, an isolation optical coupler or an isolation transformer. The FET S2 and the FET S3 receive the first external signal M1 and the second external signal M2 set by a low frequency oscillator via an AND gate U4 and an AND gate U5, respectively. A switching between the FET S2 and the FET S3 is done by the gate circuit driving signal GD generated by the modulator U1. The modulator U1 receives the zero point detecting signal ZCD and outputs the gate circuit driving signal GD.

Figure 1:
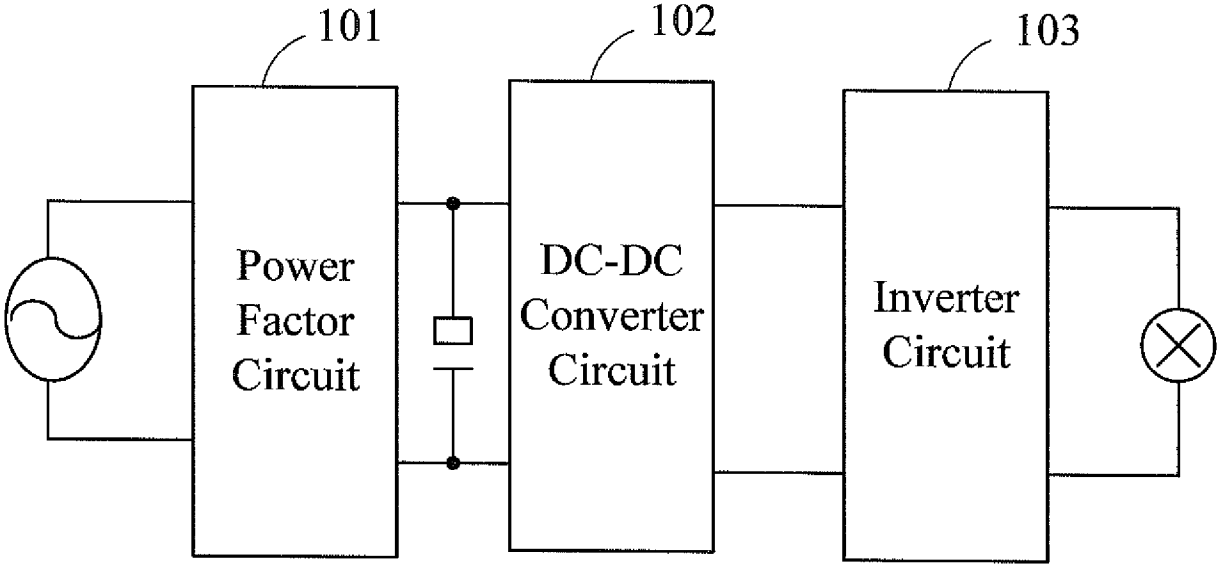
FIG. 1 Prior Art
FIG. 1 is a block diagram showing a conventional three-stage ballast module of prior art.
Figure 2:
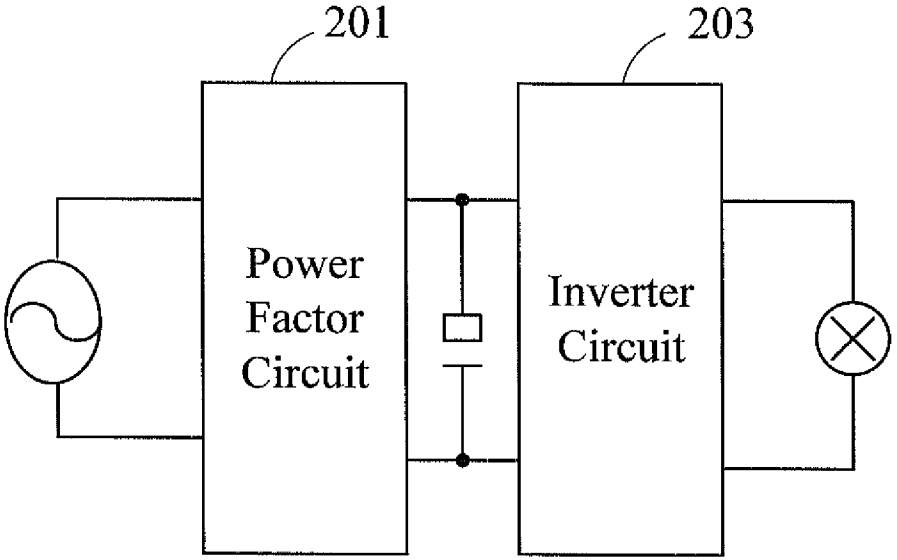
FIG. 2 Prior Art
FIG. 2 is a block diagram showing a two-stage ballast module of prior art.
Figure 3:
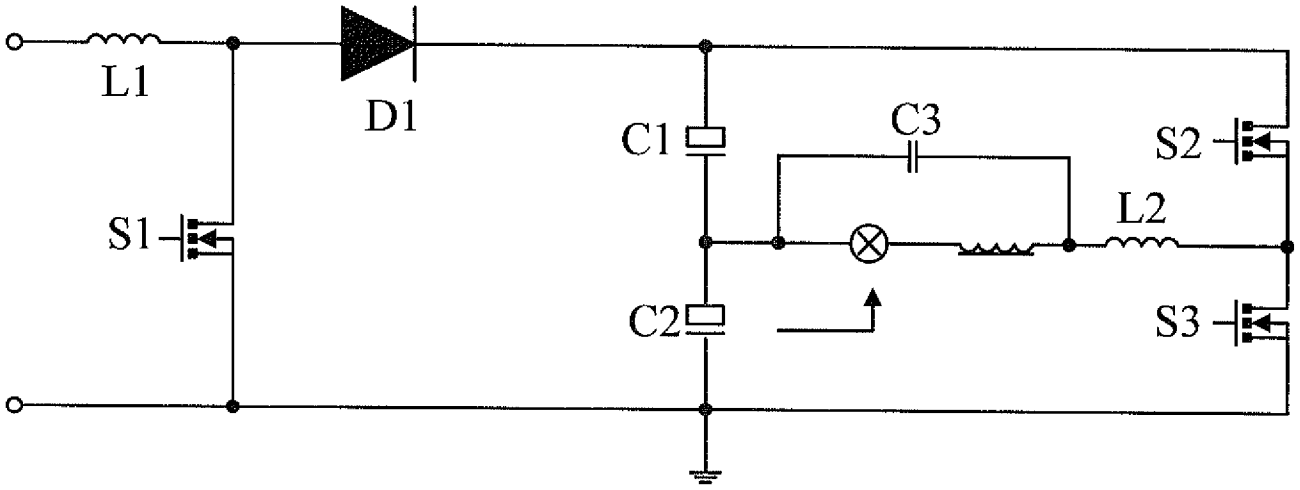
FIG. 3 Prior Art
FIG. 3 is a circuitry of the two-stage ballast module of FIG. 2.
Figure 8:
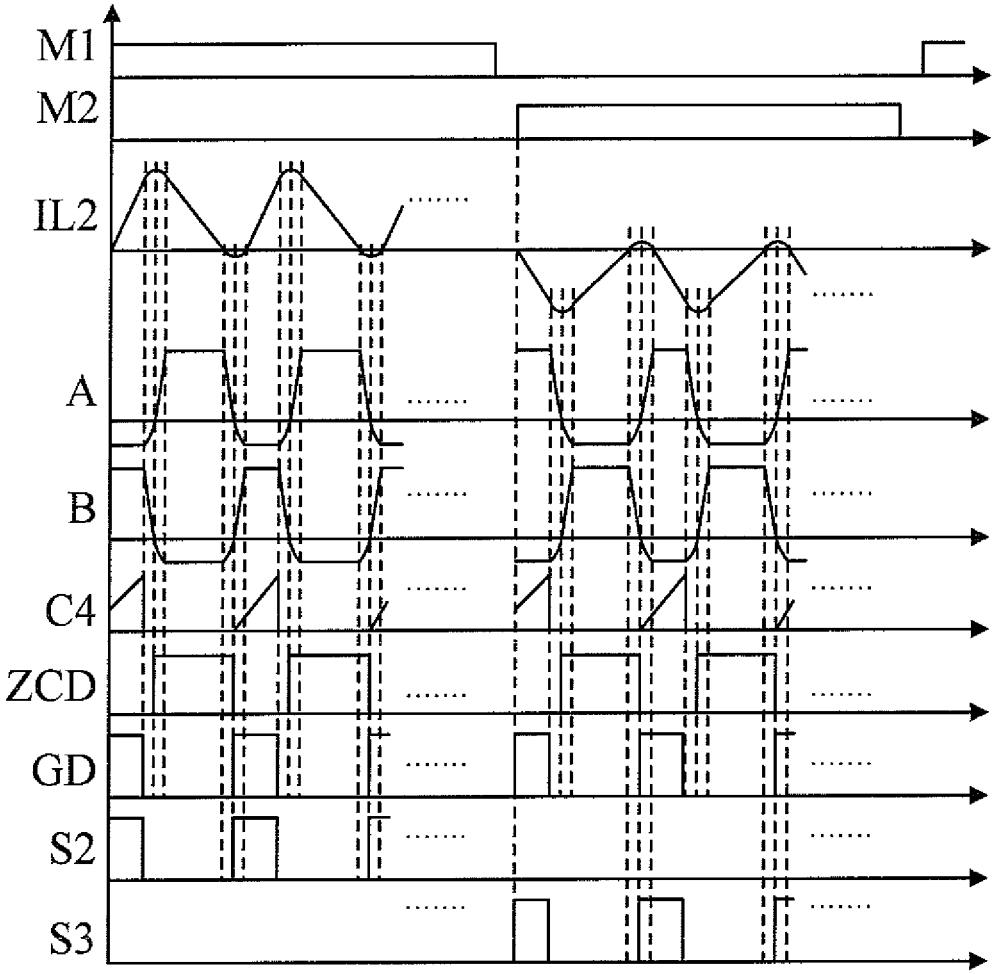
FIG. 8 is a timing chart of the circuit of FIG. 7.

Please refer to FIG. 8 in conjunction with FIG. 3 and FIG. 7, it will be described how the circuit generates the inductor current and how the circuit detects the zero point of the inductor current. FIG. 8 is a timing chart of the circuit shown in FIG. 7.

At a moment, when the gate circuit driving signal GD and the first external signal M1 are both high level, and the second external signal M2 is low level, the FET S2 and FET S4 are turned on, the FET S5 is turned off, the inductor current IL2 of the inductor L2 increases. The voltage of the different-name end A, to which the first winding L3 and the AND gate U2 as well as the diode D2 are connected, is negative, so the AND gate U2 is OFF. The voltage of the same-name end B, to which the second winding L4, the AND gate U3 as well as the diode D3 are connected, is positive, and the second external signal M2 is low level, so the AND gate is also OFF. When both the AND gates U2 and U3 are low level, the zero point detecting signal ZCD at a fifth pin of the modulator U1 is low level. The voltage of the same-name end B of the second winding L4 is positive, so the diode D3 is turned on, and the capacitor C4, which serves as an integrating capacitor, is charged via the resistor R1.

The modulator U1 has a comparator integrated therein. A positive input terminal of the comparator is connected to an external given signal for the lamp current. A negative input terminal of the comparator is connected to the fourth pint of the modulator U1. When the voltage of the capacitor C4 reaches the external given signal for the lamp current, the outputted gate circuit driving signal GD is low level. The FET S2, FET S4 are turned off, S5 is turned on. Then, the capacitor C4 is discharged through the FET S5. After the FET S2 is turned off, the current of the inductor L2 decreases, so that the voltage of the different-name end A of the first winding L3 is boosted to high level, and the voltage of the same-name end B of the second winding L4 drops to low level. The voltage of the different-name end A of the first winding L3 raising to high level results in the turning on of the AND gate U2, and the zero point detecting signal ZCD at the fifth pin of the modulator U1 is pulled to high level.

When the inductor current IL2 of the inductor L2 reduces to zero and somewhat becomes reverse, the voltage of the different-name end A of the first winding L3 drops, the polarity of the voltage of the same-name end B of the second winding L4 changes, and the zero point detecting signal ZCD is re-pulled to low level. When the zero point detecting signal ZCD becomes low level, the pin is triggered to output the gate circuit driving signal GD of a high level. When the gate circuit driving signal GD returns to be high level, the FET S2 and the FET S4 are turned on again, the inductor L2 is charged, and all the signals will repeatedly operate based on the logic in the beginning.

As shown in FIG. 8, the control circuit described above can control the inductor L2 to operate under the critical continuous inductor current mode. Therefore, the lamp current can be obtained by measuring the current IL2 of the inductor L2 with an integral circuit.

Figure 9:
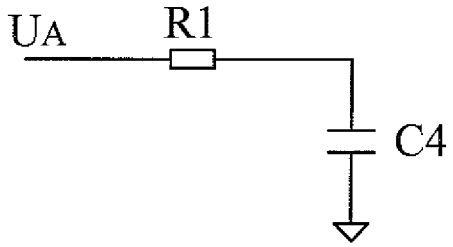
FIG. 9 shows a circuit of an integral circuit of an inductor current signal generator in FIG. 6.

Please refer to FIG. 9, the capacitor C4 and the resistor R1 constitute an integral circuit, in which:

$$V_{C4} = U_A\left(1 - e^{-\frac{t}{R1C4}}\right)$$

$$e^{-\frac{t}{R1C4}}$$

is expanded as a power series, then $$V_{C4} \approx U_A \frac{t}{R1C4},$$

that is, $R1C4V_{C4} \approx U_A t$

As described above, the inductor L2 is controlled to operate under the critical continuous inductor current mode. Then the lamp current can be calculated through:

$$I_{Lamp} = k_3 * U_A \Delta t, \left(k_3 = \frac{n}{2 * L_2}\right).$$

Therefore, the amplitude of the lamp current $I_{Lamp}$ can be controlled by controlling the voltage $V_{c4}$ at the first terminal of the capacitor C4. As can be observed from FIG. 3, during the time that the circuit is controlled by the first external signal M1 and the FET S2, the current of the inductor flows from right to left, that is, in a forward direction. As can be seen from FIG. 8, at the moment that the FET S2 is turned on, the current IL2 of the inductor L2 is somewhat reverse. When the current of the inductor L2 is reverse, a parasitic diode inside the FET S2 is ON, and therefore ensuring the voltage difference between two terminals of the FET S2 is 0. Accordingly, turning on the FET S2 with a zero voltage is realized.

If the first external signal M1 is low level, and the second external signal M2 is high, the timing logic of the circuit is symmetric to that described above, and therefore the relevant descriptions are omitted herein. The settings of the first external signal M1 and the second external signal M2 are regulated by an external low frequency oscillator.

A second embodiment of the present invention will be described now. Please refer to FIG. 10, a driving circuit 505 and a modulator 503 of a control circuit 500 described in the present embodiment are the same as the driving circuit 405 and the modulator 403 in the previous embodiment. The differences are a current zero point detector 502 and an inductor current signal generator 504.

Figure 10:
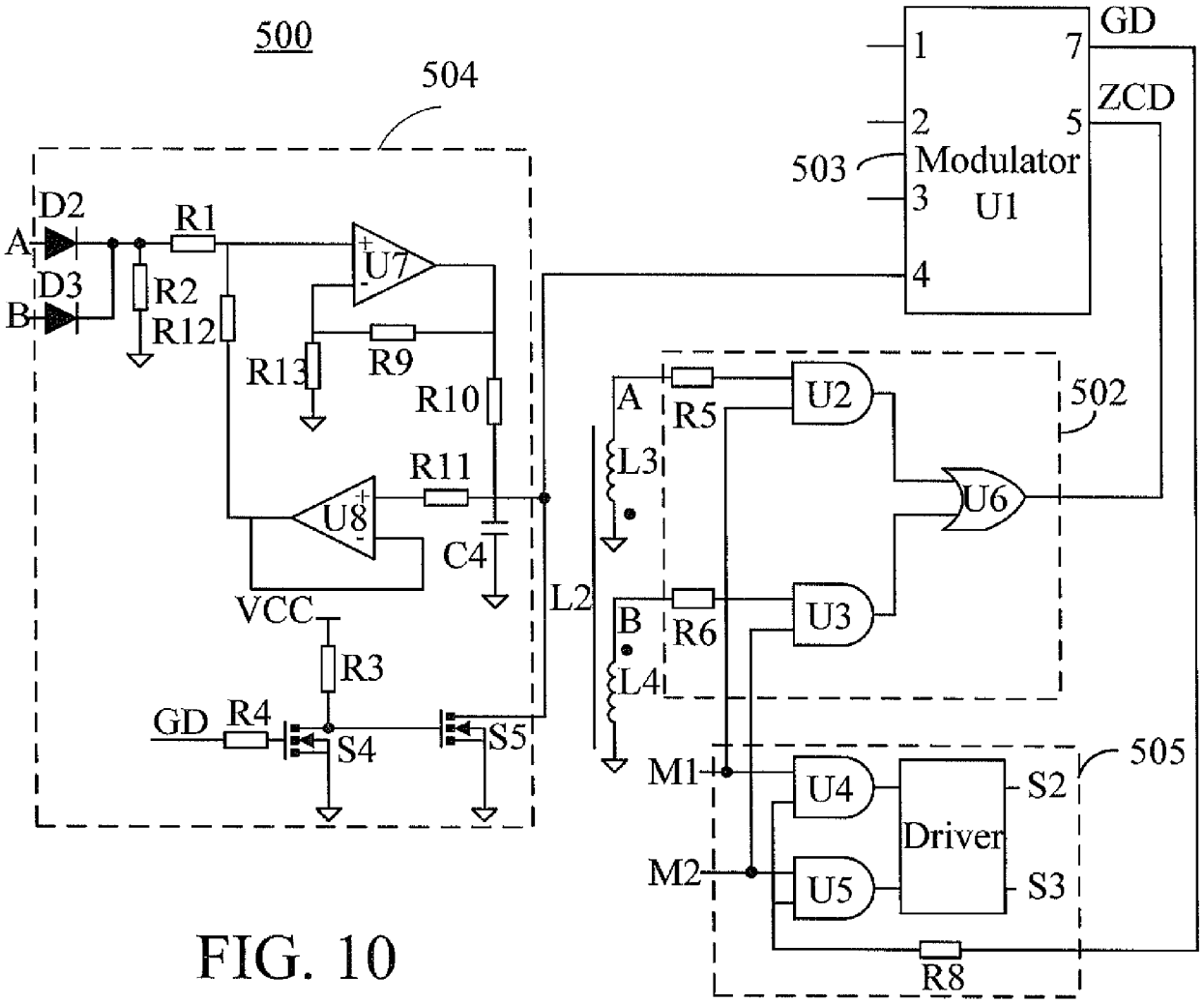
FIG. 10 shows another circuitry diagram of the control circuit of FIG. 6.

With reference to FIG. 10, in the present embodiment, the inductor current signal generator 504 comprises a resistor R1, a resistor R2, a resistor R3, a resistor R4, a resistor R9, a resistor R10, a resistor R11, a resistor R12, a resistor R13, a capacitor C4, a diode D2, a diode D3, an amplifier 117, an amplifier U8, a FET S4 and a FET S5.

In comparison with the first embodiment, the inductor current signal generator 504 further comprises a voltage control current source. The resistors R1, R2, R9, R10, R11, R12, R13, as well as the amplifiers U7 and U8 constitute a typical voltage control current source, which outputs a current proportional to the input voltage of the first winding L3 or the second winding L4. A specific connection relationship is described as follows: a first terminal of the capacitor C4 is connected with a second input terminal of the modulator U1, and a second terminal thereof is grounded. A positive pole of the diode D2 is connected to the different-name output end A of the first winding L3, and a negative pole thereof is connected with a first terminal of the resistor R1. A positive pole of the diode D3 is connected with the same-name output end B of the second winding L4, and a negative pole thereof is connected to the first terminal of the resistor R1. A second terminal of the resistor R1 is connected to a non-inverting input terminal of the amplifier U7. The resistor R2 has one terminal thereof connected with the first terminal of the resistor R1, and the other terminal thereof grounded. The non-inverting input terminal of the amplifier U7 is connected to the second terminal of the resistor R1, an inverting input terminal thereof is connected with a first terminal of the resistor R13, and an output terminal thereof is connected to a first terminal of the resistor R10. A second terminal of the resistor R10 is connected to the first terminal of the capacitor C4, and the first terminal thereof is connected to the output terminal of the amplifier U7. The amplifier U8 has an output terminal connected with the non-inverting input terminal of the amplifier U7 via the resistor R12, an inverting input terminal thereof connected to the output terminal, and a non-inverting input terminal thereof connected with the first terminal of the capacitor C4 via the resistor R11. One terminal of the resistor R9 is connected with the inverting input terminal of the amplifier U7, and the other terminal thereof is connected to the output terminal of the amplifier U7.

The voltage control current source charges the capacitor C4. There is a linear relationship between the voltage at the first terminal of the capacitor C4 and the inductor current of the second winding L4. Other control source circuits can also be applied here, and the illustrations are omitted.

In the present embodiment, a OR gate U6 is utilized in the current zero point detector 502 to replace the diode D4, the diode D5 and the resistor R7 used in the first embodiment. Output terminals of the AND gates U2 and U3 are connected to two input terminals of the OR gate U6. An output terminal of the OR gate U6 is connected to the first input terminal of the modulator U1.

In FIG. 10, the position connection relationships among the other elements are similar to those of the circuit according to the first embodiment shown in FIG. 7, in addition, the control waveforms are similar to those shown in the timing chart of FIG. 8, and therefore the descriptions thereof are omitted herein.

Figure 11:
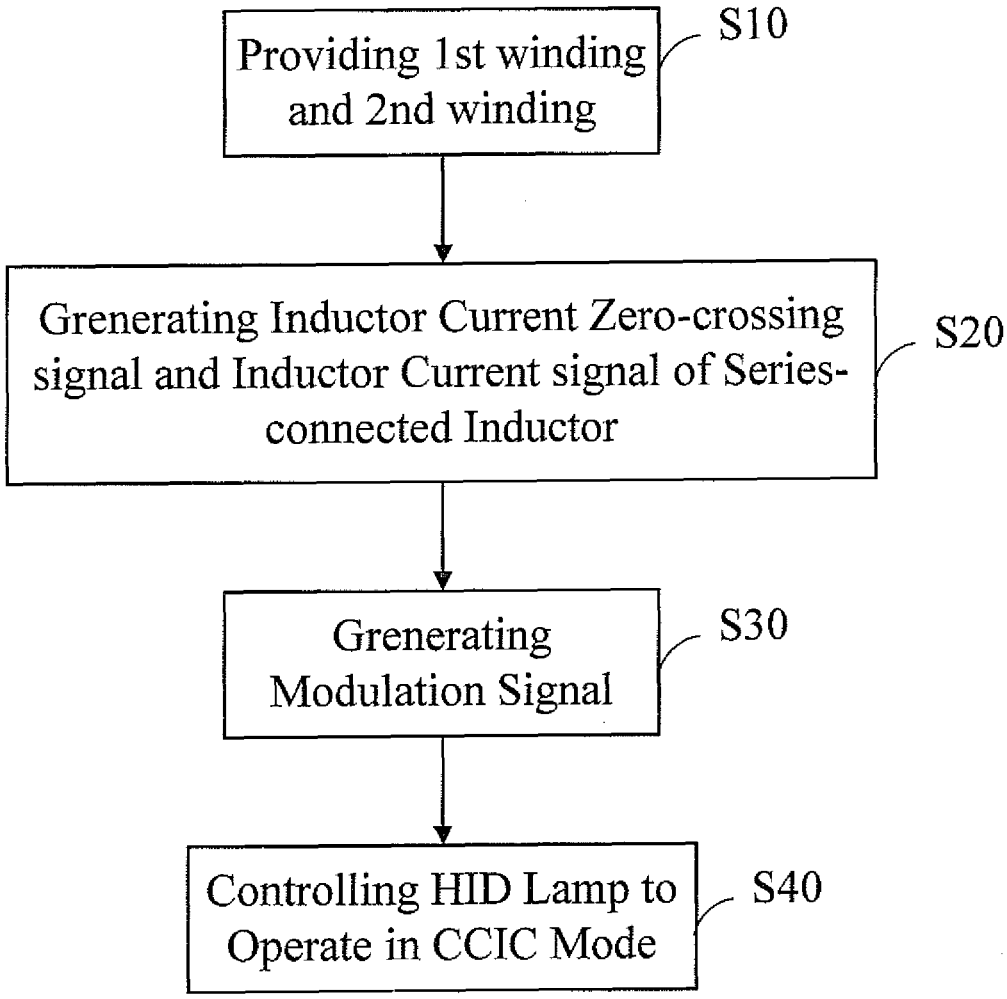
FIG. 11 is a flow chart showing a control method for the HID lamp in accordance with the present invention.

In the present invention, the current value of the HID lamp is controlled by using the peak of the critical continuous inductor current. For this reason, the peak of the critical continuous inductor current is obtained through the voltage of the windings, which are coupled with the series-connected inductor L2. With reference to FIG. 11, the HID lamp control method in accordance with the present invention comprises the following steps: in step S10, the first winding and the second winding are provided. The first winding and the second winding are coupled with the series-connected inductor of the HID lamp. The different-name end of the first winding and the same-name end of the second winding are the output terminals of the first and second windings, respectively. In step S20, the inductor current zero crossing signal and the inductor current signal of the series-connected inductor are generated by using the voltage of the first winding or the second winding. In step S30, the modulation signal is generated by using the inductor current zero crossing signal and the inductor current signal. Further, in step S40, the HID lamp is controlled to operate in the critical continuous inductor current mode according to the modulation signal, the first external signal and the second external signal.

In one embodiment of the present invention, the step of using the voltage and the first winding or the second winding comprises integrating the voltage of the first winding or the second winding. The integrating process begins at the time that the modulation signal is generated.

In one embodiment of the present invention, the integration to the voltage of the first winding or the second winding is performed by providing a capacitive unit for integrating the voltage of the first winding or the second winding. In such a scheme, the first switch unit and the second switch unit are also provided. The first switch unit is connected to the modulator, and the second switch unit is connected to the capacitive unit. When the modulation signal generated by the modulator is valid, the first switch unit is turned on and the second switch unit is turned off, causing the first winding or the second winding to charge the capacitive unit. When the modulation signal generated by the modulator is invalid, the first switch unit is turned off and the second switch unit is turned on, as a result, the capacitive unit is discharged.

In the present invention, the current value of the HID lamp is controlled by using the peak of the critical continuous inductor current. As a result, the current of the HID lamp can be controlled indirectly. Furthermore, the inductor current can be controlled to operate in the critical continuous mode by detecting the zero crossing point of the inductor current. In addition, the FET S2 and the FET S3, which are connected with the driving circuit 405 of the control circuit 400 or 505 of the control circuit 500, can be turned on with zero voltage, so as to reduce the switching wear of the FETs S2 and S3, improve the system efficiency, and prolong the service lifetime of the FETs.

While the preferred embodiments of the present invention have been illustrated and described in detail, various modifications and alterations can be made by persons skilled in this art. The embodiment of the present invention is therefore described in an illustrative but not restrictive sense. It is intended that the present invention should not be limited to the particular forms as illustrated, and that all modifications and alterations which maintain the spirit and realm of the present invention are within the scope as defined in the appended claims.

What is claimed is:

1. A high intensity discharge lamp control circuit, comprising:

a first winding and a second winding, both of the first winding and the second winding being coupled with a series-connected inductor of a high intensity discharge lamp;

a current zero point detector having a first input terminal, a second input terminal and an output terminal, the first input terminal and the second input terminal of the current zero point detector being connected with a different-name end of the first winding and a same-name end of the second winding, respectively, the current zero point detector being used for detecting an inductor current zero crossing signal of the high intensity discharge lamp;

an inductor current signal generator having a first input terminal, a second input terminal, a third input terminal and an output terminal, the first input terminal and the second input terminal of the inductor current signal generator being connected with the different-name end of the first winding and the same-name end of the second winding, respectively, the third input terminal of the inductor current signal generator receives a signal related to the inductor current zero crossing signal to generate an inductor current signal in the circuit;

a modulator having a first input terminal, a second input terminal and an output terminal, the first input terminal and the second input terminal of the modulator being connected with the output terminal of the current zero point detector and the output terminal of the inductor current signal generator, respectively, the output terminal of the modulator being connected so as to output a modulation signal; and a driving circuit having a first input terminal, a second input terminal, a third input terminal and an output terminal, for driving switches in the high intensity discharge lamp control circuit, the first input terminal of the driving circuit being connected with the output terminal of the modulator to receive the modulation signal outputted by modulator, the second input terminal and the third input terminal of the driving circuit being connected with a first external signal and a second external signal, respectively, the output terminal of the driving circuit being connected to the high intensity discharge lamp through an inverter circuit for controlling the inductor current to operate in a critical continuous inductor current mode.

2. The high intensity discharge lamp control circuit according to claim 1, wherein the current zero point detector comprises a detecting circuit, the detecting circuit generates a zero point detecting signal and outputs the same to the modulator according to a level of the first winding and the first external signal, alternatively, according to a level of the second winding and the second external signal.

3. The high intensity discharge lamp control circuit according to claim 2, wherein the current zero point detector comprises:

a first AND gate, a first terminal of the first AND gate being electrically connected to the different-name end of the first winding, and a second terminal thereof being electrically connected to the driving circuit for the high intensity discharge lamp;

a second AND gate, a first terminal of the second AND gate being electrically connected to the same-name end of the second winding, and a second terminal thereof being electrically connected to the driving circuit for the high intensity discharge lamp, wherein output terminals of the first AND gate and the second AND gate are both electrically connected to the modulator.

4. The high intensity discharge lamp control circuit according to claim 3, wherein the current zero point detector further comprises:

a first OR gate, both input terminals thereof being electrically connected with the output terminal of the first AND gate and the output terminal of the second AND gate, and an output terminal of the first OR gate being electrically connected to the modulator.

5. The high intensity discharge lamp control circuit according to claim 1, wherein the inductor current signal generator comprises a capacitive unit, the capacitive unit is electrically connected with the modulator, the capacitive unit starts to be charged when the modulator generates the modulation signal.

6. The high intensity discharge lamp control circuit according to claim 5, wherein the inductor current signal generator further comprises a first switch unit and a second switch unit connected in series, the first switch unit is connected with the modulator, the second switch unit is connected with the capacitive unit, the first switch unit is turned on and the second switch unit is turned off when the modulation signal generated by the modulator is valid, causing the first winding or the second winding to charge the capacitive unit, the first switch unit is turned off and the second switch unit is turned on when the modulation signal generated by the modulator is invalid, so as to discharge the capacitive unit.

7. The high intensity discharge lamp control circuit according to claim 6, wherein the first switch unit comprises a first field effect transistor, and the second switch unit comprises a second field effect transistor, a gate of the first field effect transistor is electrically connected to the modulator, a drain of the first field effect transistor is electrically connected with a gate of the second field effect transistor, and a drain of the second field effect transistor is electrically connected to the capacitive unit.

8. The high intensity discharge lamp control circuit according to claim 5, wherein the inductor current signal generator further comprises a capacitor charging control unit, input terminals of the capacitor charging control unit are electrically connected to the first winding and the second winding, and an output terminal of the capacitor charging control unit is electrically connected with the capacitive unit, the capacitor charging control unit permits a current to flow from the input terminal to the output terminal, and prevents the current from flowing from the output terminal to the input terminal.

9. The high intensity discharge lamp control circuit according to claim 8, wherein the capacitor charging control unit comprises two diodes, positive poles of the two diodes, which serve as input terminals of the capacitor charging control unit, are electrically connected with the first winding and the second winding, respectively, and negative poles of the two diode, which serve as output terminals of the capacitor charging control unit, are both electrically connected to the capacitive unit.

10. The high intensity discharge lamp control circuit according to claim 5, wherein the inductor current signal generator further comprises a voltage control current source, input terminals of the voltage control current source are electrically connected with the first winding and the second winding, and an output terminal thereof is electrically connected with the capacitive unit.

11. The high intensity discharge lamp control circuit according to claim 1, wherein the modulator outputs the modulation signal to the driving circuit according to a level of the first winding and the first external signal, alternatively, according to a level of the second winding and the second external signal.

12. The high intensity discharge lamp control circuit according to claim 11, wherein the driving circuit drives the high intensity discharge lamp through the inverter circuit when the modulation signal from the modulator is valid, in addition, the first external signal or the second external signal is also valid.

13. The high intensity discharge lamp control circuit according to claim 1, wherein the first winding and the second winding have the same number of turns.

14. The high intensity discharge lamp control circuit according to claim 1, wherein a polarity of the signal related to the inductor current zero crossing signal is the same or opposite with respect to a polarity of the inductor current zero crossing signal.

15. The high intensity discharge lamp control circuit according to claim 1, wherein the third input terminal of the inductor current signal generator is connected with the output terminal of the current zero point detector.

16. The high intensity discharge lamp control circuit according to claim 1, wherein the third input terminal of the inductor current signal generator is connected with the output terminal of the modulator.

17. A high intensity discharge lamp control method, comprising:

providing a first winding and a second winding, both of the first winding and the second winding being coupled with a series-connected inductor of a high intensity discharge lamp;

generating an inductor current zero crossing signal and an inductor current signal of the series-connected inductor by using a voltage of the first winding or the second winding;

generating a modulation signal by using the inductor current zero crossing signal and the inductor current signal; and controlling the inductor current to operate in a critical continuous inductor current mode according to the modulation signal, a first external signal and a second external signal.

18. The high intensity discharge lamp control method according to claim 17, wherein the step of using the voltage of the first winding or the second winding comprises integrating the voltage of the first winding or the second winding, and the integrating process begins when the modulation signal is generated.

* * * * *